United States Patent [19]

Hergeth et al.

[11] Patent Number: 4,715,722

[45] Date of Patent: Dec. 29, 1987

[54] PROCESS AND APPARATUS FOR FEEDING FIBER MATERIAL

[75] Inventors: Adolph Hergeth, Dülmen; Günter Lucassen, Haltern, both of Fed. Rep. of Germany; Akiva Pinto, Gastonia, N.C.

[73] Assignee: Hergeth Hollingsworth, GmbH, Duelmen, Fed. Rep. of Germany

[21] Appl. No.: 832,905

[22] Filed: Feb. 24, 1986

[30] Foreign Application Priority Data

Feb. 23, 1985 [DE] Fed. Rep. of Germany ..... 3506476
Feb. 8, 1986 [DE] Fed. Rep. of Germany ..... 3603997

[51] Int. Cl.[4] ..... B01F 15/02

[52] U.S. Cl. ..... 366/132; 366/153; 366/154; 366/163; 366/182; 366/186; 366/271; 406/82; 406/164

[58] Field of Search ..... 366/154, 155, 150, 153, 366/183, 186, 182, 194, 195, 271, 163, 30, 33, 27–29, 49, 132, 131, 133, 341, 348, 349, 603; 414/225, 752; 406/114–116, 164, 82, 77; 241/101 A, 60, 277, 283

[56] References Cited

U.S. PATENT DOCUMENTS

| | | | |
|---|---|---|---|
| 2,721,359 | 10/1955 | Morgan | 366/186 X |
| 3,979,152 | 9/1976 | Morey et al. | 406/164 X |
| 4,264,241 | 4/1981 | Hock | 406/116 X |
| 4,324,495 | 4/1982 | Martinez | 366/271 |
| 4,365,764 | 12/1982 | Marx | 406/115 X |
| 4,470,705 | 9/1984 | Boice et al. | 366/186 |

*Primary Examiner*—Timothy F. Simone
*Attorney, Agent, or Firm*—Cort Flint

[57] ABSTRACT

From a device (46) for opening pressed bales of fiber material set up in a row (39, 40), the opened fiber material is conveyed pneumatically (55) to a hopper feeder (1). A receiving chamber (13) and upwardly extending inclined spiked feed lattice (3) are provided in hopper feeder (1) for delivering fiber to a processing machine via outlet (8). The delivery of the fiber material, removed continuously from the row of bales, to receiving chamber (13) of hopper feeder (1) is performed transversely to the latter, and in parallel to spiked feed lattice (3). In another embodiment a filling chamber (13*a*) may be advantageously compartmentalized by transverse walls (57, 58) and provided with a bottom conveyor (56). Fiber is removed in a height direction from a longitudinal face of the fiber bed formed in filling chamber (13*a*) of fiber feeding device (19).

24 Claims, 4 Drawing Figures

PROCESS AND APPARATUS FOR FEEDING FIBER MATERIAL

BACKGROUND OF THE INVENTION

The invention relates to a process and apparatus for feeding fiber material, in particular cotton, etc. from a device for opening pressed bales of fiber material set up in series to a hopper feeder. The fiber material is opened and successively removed layerwise from the fiber bales and pneumatically fed to the hopper feeder. The fiber material is fed into a filling chamber in the hopper feeder to form a fiber material bed, and then delivered to a processing machine.

For mixing opened fiber material from fiber bales set up in series, it has been known to supply to a hopper feeder the fiber material successively removed layerwise from pressed bales set up in a row. Generally, the hopper feeder comprises an inclined spiked feed lattice directed upwardly and outwardly, with a receiving chamber arranged ahead thereof for the supplied fiber material. Further, a reciprocating feeding means is provided for the fiber material supplied from the bale opener. The fiber material removed layerwise from the row of bales includes a certain mixture of fibers of all bales of a row of bales. A further mixing may be preformed in the hopper feeder in that the supplied fiber material is heaped in height in the receiving chamber of the hopper feeder. The spiked feed lattice of the hopper feeder takes fiber material from the bottom to the top at the end face of the fiber heap in the receiving chamber of the hopper feeder. From the bale opener, the fiber material is supplied by the feeding means reciprocating above the receiving chamber in a direction vertical to the surface of the spiked feed lattice. As a result, the constructional height of the hopper feeder is restricted and the speed of the reciprocating movement of the feeding means is limited as well so that the fiber material fed to the spiked feed lattice is disposed consecutively relative to the latter in the hopper feeder. Therefore, the fiber material situated at the fiber bed endside surface which is confronted with the spiked feed lattice originates from a low number of bales of the row of bales. While a further mixing of the fiber material is realized by its passage through the hopper feeder, the mixing effect is not very intense, particularly if the number of bales forming a row in connection with the opening means is high.

Accordingly, an object of the invention is to improve the mixing effect for fiber material in a hopper feeder which has been delivered from pressed bales of fiber material set up in a row. The invention is characterized in that the the fiber material removed continuously from the row of bales forms a fiber material bed in the filling chamber of the hopper feeder. Delivery into the chamber is performed in a longitudinal direction to the fiber bed being formed. Fiber is removed from the fiber bed in a direction of the height of one of the longitudinal sides of the bed.

SUMMARY OF THE INVENTION

In accordance with the invention, a larger number of bales may be processed for direct presentation to the spiked feed lattice. In case of a plurality of bales in the opening device, the respective milled fiber amounts are piled up in the hopper feeder directly at the spiked feed lattice. The fiber amounts remain in the frontmost space in the receiving chamber of the hopper feeder. The spiked feed lattice may seize simultaneously the directly presented fiber amounts originating from the larger number of bales in a manner that the mixing effect is increased. The row of bales at the opening means may be much longer to provide the larger number of bales. Further, the resultant hopper feeder may be of a substantially shorter and more compact design than that of prior large-capacity hopper feeder which are of a considerable length. The space requirements of the hopper feeder are substantially less. The space now available may be used for other purposes.

The fiber material may be fed at adjustable speeds during a reciprocal movement to the filling chamber. The speed of the feeding means may be dictated by the speed of the removing means of the bale opener.

According to another feature of the invention, a device for mixing fiber material includes a hopper feeder to which fiber is delivered from a device for opening pressed bales of fiber set up in series. The mixing device includes a feeding means adapted to reciprocate lengthwise of the fiber material bed being formed in the hopper feeder and a removing means provided at one longitudinal side of the fiber material bed. The speed of the driving unit for the feeding means of the hopper feeder may be changed, and the speed of the driving unit for the fiber removing means of the bale opener may be controlled by interdependence.

The feeding means for the hopper feeder may be a pneumatically operating condenser connected to the removing means of the bale opener for the fiber bale row.

Further, a filling chamber of the hopper feeder may contain a bottom conveyor belt movable transversely to the longitudinal side of the fiber material bed.

The hopper feeder may be designed in different ways. As seen in cross-section, the filling chute of the hopper feeder may be limited by walls extending more or less obliquely or vertically to the lower part of a spiked feed lattice or of the bottom conveyor belt. Moreover, ahead of the spiked feed lattice there may be provided a chute chamber adapted to the inclined position of the former and forming an acute angle to the filling chute which may be subdivided by transverse walls to form sections which may be provided with removable cover plates for the optional filling of said sections.

According to another feature of the invention, the hopper feeder is provided with a filling chute having inclined walls preferably extending parallel and directed to the lower portion of the spiked feed lattice. The feeding means for the fiber material may be mounted to extend in the direction of the chute width at the filling aperture of the inclined chute formed by the oblique walls. Advantageously, the feeding means used is a pneumatically operating condenser which is connected to the removing means of the opener for the row of fiber bales.

In advance of the spiked feed lattice of the hopper feeder there may be provided a chute chamber adapted to the inclined position of the spiked feed lattice and forming an angle with the filling chute space. The cross-section of the chute space may be variable.

According to another embodiment of the hopper feeder of the invention, the upper portion of the filling chute for the material supplied by the opener of the row of fiber bales may be vertical, an inclined chute being adjoined thereto.

Above the filling opening of the inclined chute or the like, rails extending in parallel to the surface of the spiked feed lattice are provided on which the feeding means in the advantageous form of a condenser may travel to and fro.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

Description of a Preferred Embodiment

Figure 1:
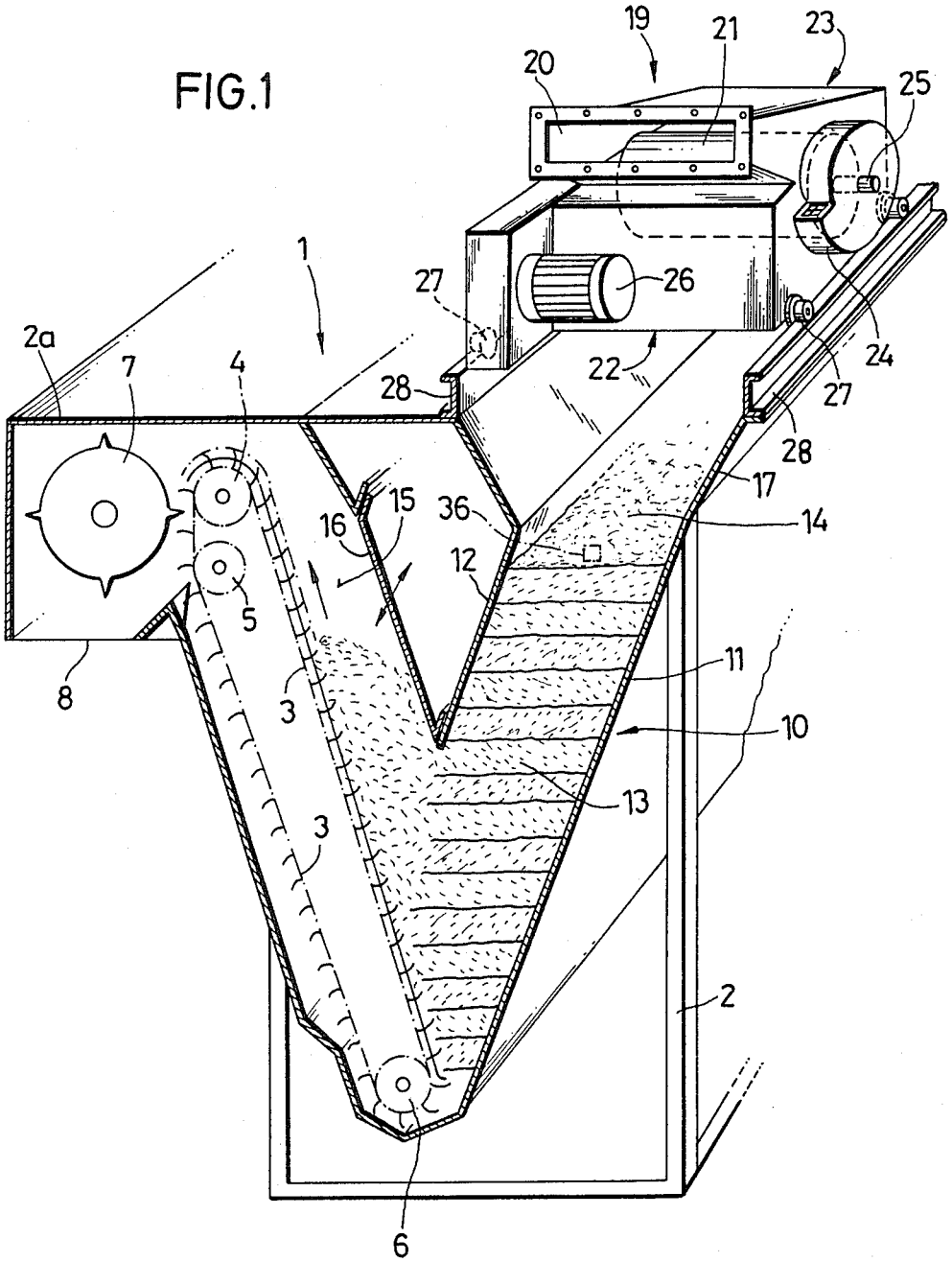
FIG. 1 is a schematic cross-section of one embodiment of the hopper feeder of the invention.

The hopper feeder, generally designated at 1, is illustrated for opening and mixing fiber material to be uniformly fed to a subsequent machine, for example a carding machine. The hopper feeder comprises a housing 2 in which a spiked feed lattice 3 is positioned obliquely and circulated upwardly about rollers 4, 5 and 6. The upper end of the spiked feed lattice 3 is followed by a stripper roller 7 which is supported in the housing portion *2a*. The conveyed material may drop through opening 8 onto a conveyor belt (not illustrated) from which it is supplied to the subsequent processing machine.

Hopper feeder 1 is provided with a filling chute, designated generally at 10, which, as seen in cross-section, is defined by inclined walls 11 and 12 inclined towards the lower part of spiked feed lattice 3. Inclined walls 11 and 12 may extend parallel to one another. They enclose a receiving chamber 13 in which the fiber material supplied through chute input opening 14 may accumulate to rest directly in advance of the lower part of spiked feed lattice 3.

An outlet chute 15 extends directly beside the spiked feed lattice 3. Chute 15 is adapted to freely accept the fiber material entrained by the spiked feed lattice 3 and an adjustable wall 16. Wall 16 may be in the form of a flap or of a wall being adjustable parallel to itself, permitting change of the cross-section of chute 15. The upper end of receiving chamber 13 is suitably flared like a funnel 17.

Above the opening 14 of filling chute 10, there is a feeding means, designated generally as 19. Feeding means 19 reciprocates transversely to the extension of the spiked feed lattice 3 for the delivery of fiber material. Feeding means 19 may conveniently be a condenser which includes a feed aperture 20, a perforated drum 21, an outlet opening 22, and a suction blower 24. Suction blower 24 is positioned outside a housing, designated generally as 23, of the condenser being driven by shaft 25 of perforated drum 21. Shaft 25 is driven via transmission elements by motor 26. The housing 23 of the condenser 19 is provided with wheels 27 adapted to run along rails 28 so that condenser 19 may travel to and fro parallel to the surface of the spiked feed lattice 3 over the width of housing 2 of hopper feeder 1.

Figure 2:
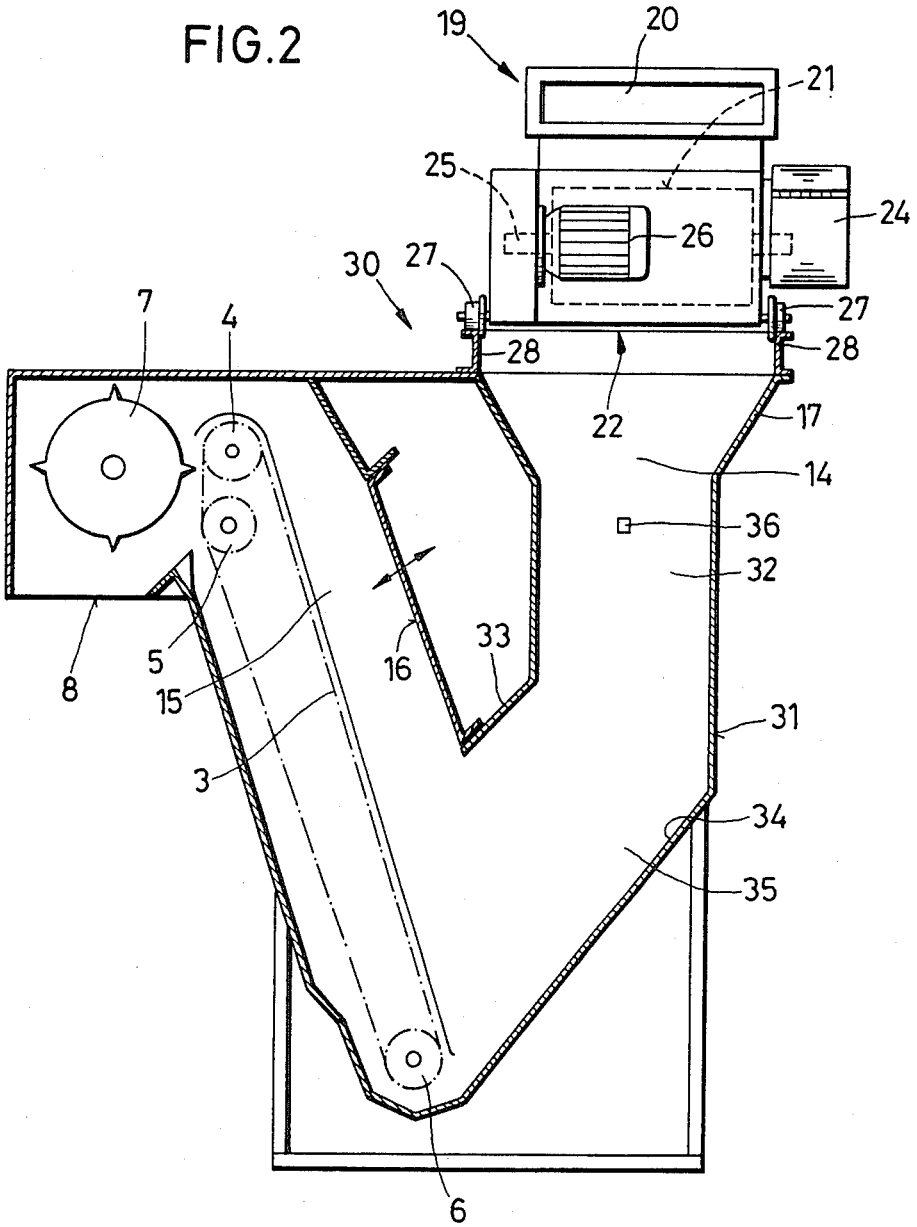
FIG. 2 is another schematic cross-section of an embodiment of the hopper feeder of the invention.

In the embodiment of a hopper feeder, designated generally at 30 in FIG. 2, a housing 31 of the hopper feeder is designed so a filling chute 32 first extends vertically. From a specific height, boundary walls 33 and 34 of the filling chute 32 extend at an inclined angle for feeding the fiber material to the lower portion of spiked feed lattice 3.

The chamber receiving the delivered fiber material is composed of a vertical part 32 and short oblique chute 35. Condenser 19 of hopper feeder 30 travels transversely to spiked feed lattice 3 in a manner that the fiber material may accumulate layerwise transversely to the spiked feed lattice. There is a filling height scanner 36 by which the filling height of the chute may be kept constant.

Figure 3:
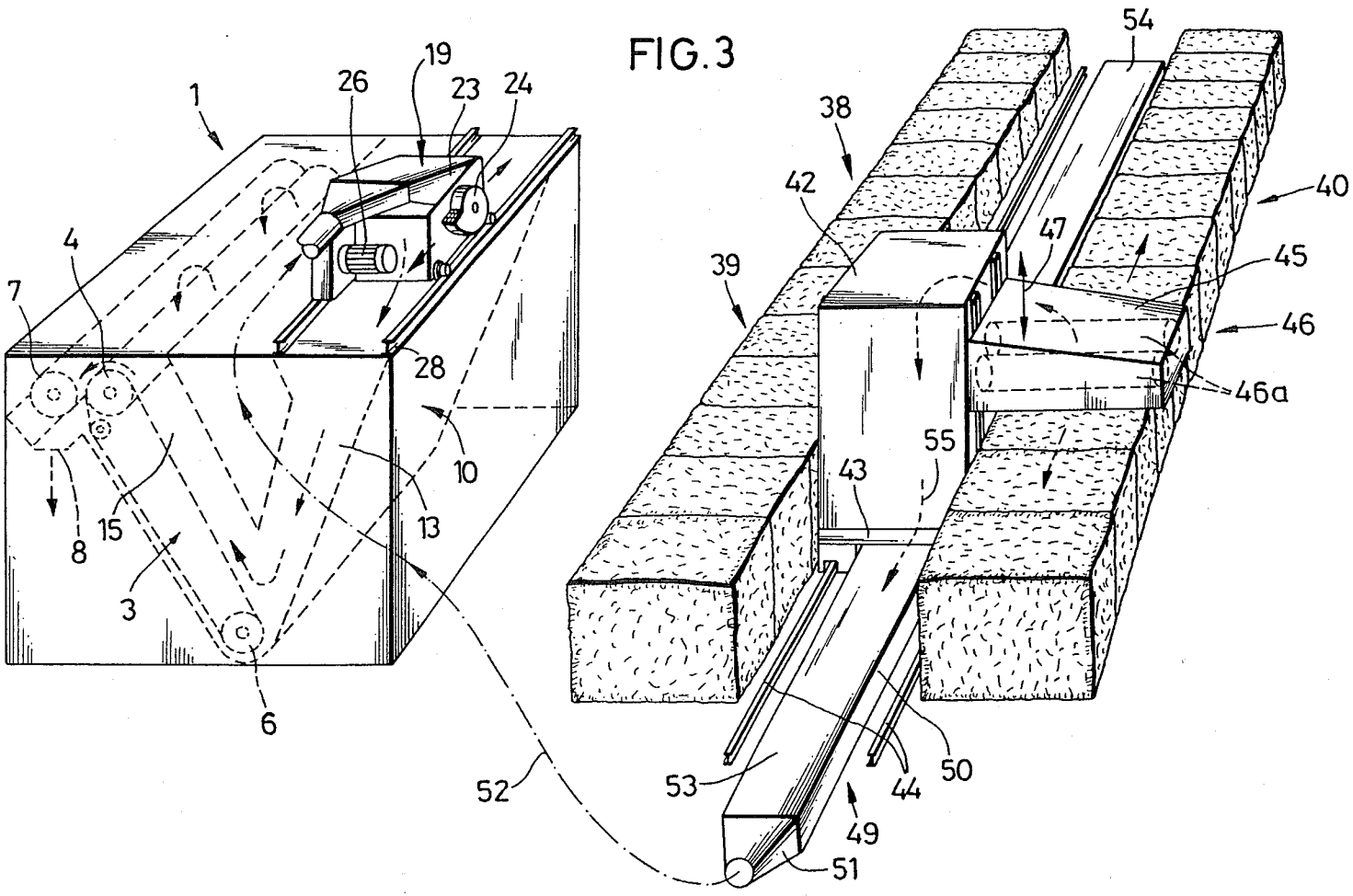
FIG. 3 is a perspective view of the cooperation of the hopper feeder of the invention in connection with pressed bales set up in series.

FIG. 3 shows an opening means, designated generally as 38, for at least one row of bales in conjunction with feeding means 1. Opening means 38 is illustrated for opening and removing flocks and fiber from a row of fiber bales, designated generally at 39 or 40, as including a frame 42 adapted to reciprocate on a carriage 43 along the row of bales 39, 40. To this end, the wheels (not illustrated) of the carriage 43 are conducted on a rail guidance 44. One side of the frame 42 is provided with a jib 45 housing a milling device, designated generally at 46, for reducing the fiber bales. Milling device 46 comprises two milling rolls **46*a*, rotatingly driven about their longitudinal axes. As indicated by arrow 47, the jib 45 with the milling device 46** may be moved up and down in height by means of an adjustable advance.

Beneath frame 42 and carriage 43 there is an assembly, designated generally at 49, to catch and carry away the flocks and fiber removed from the rows of bales. Assembly 49 is formed of a box 50 having one closed end and capable of receiving the fibrous flocks dropping within the frame 42. Box 50 is connected by means of an outlet 51 to a pneumatically operating conveyor line 52. The upper side of the box 50 is sealingly closed by a band 53, the ends of which are fixed at each side of the frame. Band 53 and a band 54 sealing the box 50 may be connected to winches (not illustrated) by means of their ends projecting into the frame 42.

By this means, the frame 42 closed by the box 50 may be reciprocated while the removed fiber flocks are conveyed by suction from the jib 45 within frame 42 to box 50, as drafted by arrow 55. The suction effect may be produced with the aid of motor 26 by means of suction blower 24 fitted at condenser housing 23.

If a row of fiber bales is reduced with the use of the opening means 38, fibers or flocks are taken off bales 40 or 39 by means of milling device 46 during the reciprocating movement of frame 42. The fibers are successively removed from the fiber bales set up in a row to be carried away by means of suction. At the same time, the removed fibers are automatically mixed. The bales of row 40 and/or 39 may contain fibers of a different quality, and subject to the kind of desired mixture, bales in a row may be combined to groups of the same or different type.

The fibers mixed by the opening means 38 in the above explained manner pneumatically get to the condenser 19 to be deposited parallel to spiked feed lattice 3 in receiving chamber 13 of feeding means 1. Housing 23 is adapted to have a predetermined width. The fiber mixture delivered from condenser 19 is directly offered to spiked feed lattice 3 over its total width. Thus, fibers of a greater number of fiber bales may be simultaneously seized by the spiked feed lattice and the resultant mixing effect is increased. A relatively large number of bales of a row at the opening means may be covered for the further mixture with feeding means 1. At the same time, it is possible to mix a lot of small fiber amounts.

Figure 4:
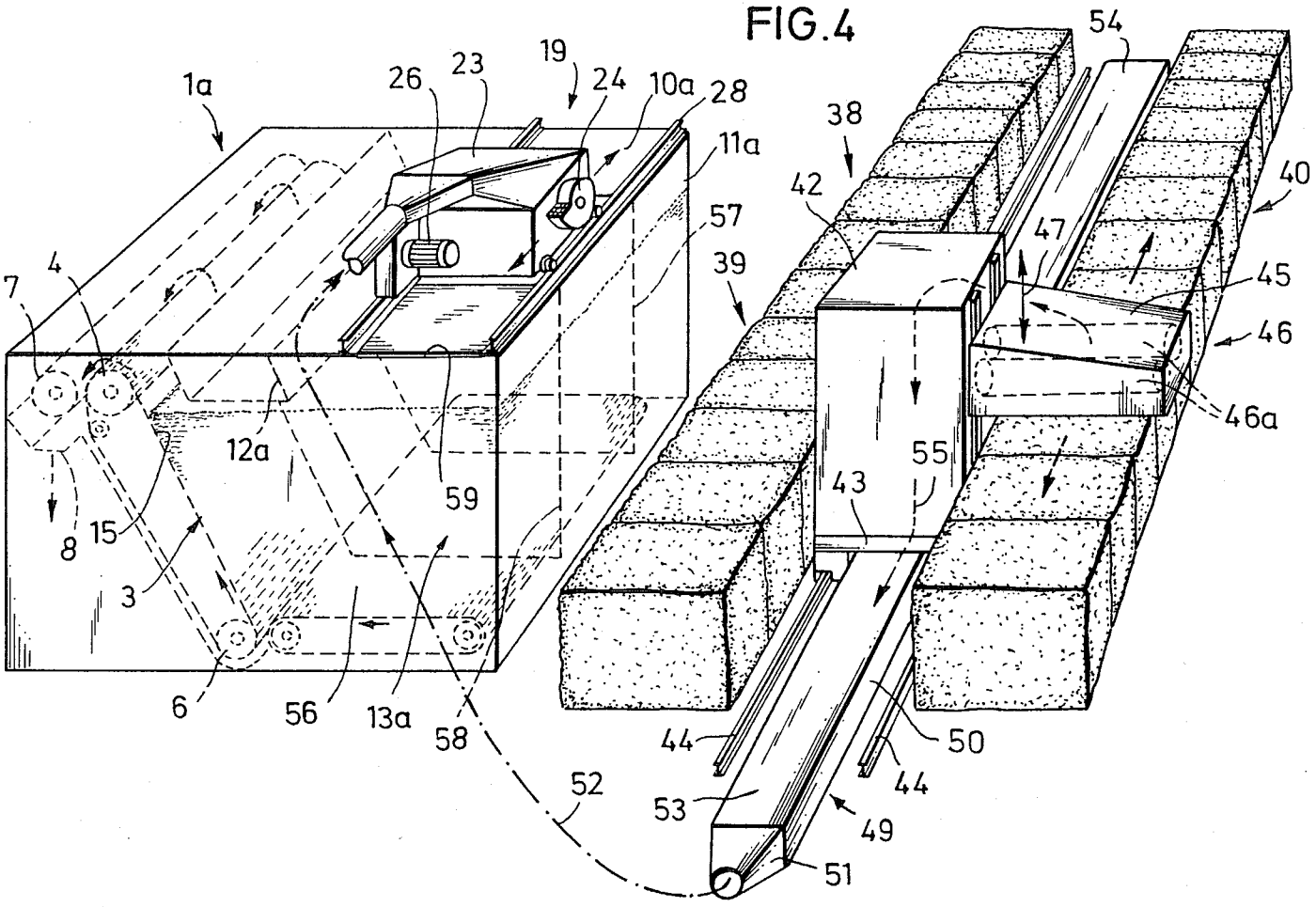
FIG. 4 is a perspective view of a modified form of a hopper according to the invention.

In the embodiment of FIG. 4, a hopper feeder 1*a* is provided with a filling chute 10*a* which as seen in cross-section is limited by a vertically extending housing wall 11*a* and a wall 12*a* extending obliquely which may be substantially adapted to the inclination of the spiked feed lattice 3. The filling chute 10*a* forms a collection chamber 13*a* in which the supplied fiber material may accumulate. At the bottom of the filling chute 10*a*, there may be provided a feed lattice or bottom belt 56 by which the accumulated material is delivered to the spiked feed lattice. The speed of the bottom belt 56 is changeable responsive to the movement of the spiked feed lattice 3 or to the feeding means 19. Further the filling chutes 10, 10*a*, 32 may be subdivided by transverse walls 57, 58 into sections, and the forming filling chamber sections may be of equal or different size.

The filling chute sections may be provided with removable flaps or slides 59. This is particularly applicable to the pneumatic feeding of the fiber material when the fiber current is conducted only in one section in a predetermined time sequence. Thus, there is an additional possibility of influencing the mixture of the fiber material depending on which filling chamber sections are provided and which of them are selected for being supplied with fiber material.

To obtain an excellent mixing effect, the speeds of the movement of the feeding means 19 and of the movement of frame 42 may be harmonized with the removing means 46 and, if necessary, with the bottom belt 56. All of the three speeds are controllable. Due to a suitable setting of the speed of the feeding means 19 and of the frame 42 of the bale opener, the fiber material of a specific bale may be dropped, for example, on the right side, in the center, or on the left side of the filling chamber of the hopper feeder. As a result, the mixing of the components of the fiber material is particularly intense.

While a preferred embodiment of the invention has been described using specific terms, such description is for illustrative purposes only, and it is to be understood that changes and variations may be made without departing from the spirit or scope of the following claims.

What is claimed is:

1. In a textile process for feeding fiber material, such as cotton and the like, from an opening device which opens pressed bales of fiber material set up in a row to a hopper feeder, said process being of the type which comprises delivery of the opened fiber material successively removed layerwise from the bales by pneumatic means to the hopper feeder into a receiving chamber ahead of an inclined upwardly extending spiked feed lattice for the transmittal to a processing machine, wherein the improvement comprises delivering the fiber material removed continuously from the row of bales to the receiving chamber of the hopper feeder transversely to the hopper feeder and parallel to the spiked feed lattice in a manner that said fibers are deposited layerwise across and parallel to the spiked feed lattice.

2. Apparatus for feeding fiber material such as cotton and the like from an opening device for opening pressed bales of fiber material set up in a row to a hopper feeder, said hopper feeder being of the type which comprises an inclined upwardly and outwardly directed spiked feed lattice, a receiving chamber for the delivered fiber material and a reciprocating feeding means for supplying the fiber material from a bale opening means which removes the fiber material layerwise from the bales set up in a row wherein the improvement comprises means for mounting said feeding means over a chute input opening of said hopper feeder in a manner that said feeding means reciprocates along said chute input opening and transversely and parallel to extension of said spiked feed lattice.

3. Apparatus according to claim 2 wherein said hopper feeder includes a filling chute below said chute input opening having inclined walls inclined to a lower portion of said spiked feed lattice; said chute input opening extending across a width of said chute for receiving fiber from said feeding means; said feeding means being carried above said chute filling opening in a manner that said feeding means travels in a reciprocating motion back and forth along said width of said chute.

4. Apparatus according to claim 3 wherein said feeding means includes a pneumatically operating condenser connected to the opening device for the row of fiber bales.

5. Apparatus according to claim 2 including an outlet chute defined in part by said spiked feed lattice; said outlet chute arranged in a fiber advance direction of said spiked feed lattice extending at an inclined angle to said filling chute.

6. Apparatus according to claim 3 including an outlet chute space defined in part by said spiked feed lattice; said outlet chute arranged in a fiber advance direction of said spiked feed lattice extending at an inclined angle to said filling chute.

7. Apparatus according to claim 5 wherein said outlet chute is further defined by an adjustable wall opposite said spiked feed lattice which is adjustable in a manner that an outlet space between said spiked feed lattice and said adjustable wall may be varied in its dimension.

8. Apparatus according to claim 6 wherein said outlet is further defined by an adjustable wall opposite said spiked feed lattice which is adjustable in a manner that an outlet space between said spiked feed lattice and said adjustable wall may be varied in its dimension.

9. Apparatus according to claim 7 wherein an upper portion of the filling chute is vertical.

10. For use in a textile process for feeding fiber from a fiber opening device which opens pressed bales of fiber arranged in a row to a hopper feeder of the type having a chute input opening, a filling chute below said input opening, and an inclined spiked feed lattice inclined to said filling chute for conveying fiber from said filling chute to an associated textile processing machine wherein the improvement comprises:

delivering said fiber into said chute input opening by a reciprocating feeding means which reciprocates along said chute input opening;

delivering said fiber into said chute input opening by said feeding means in a manner that said fibers are deposited in layers in said filling chute generally across and parallel to said spiked feed lattice so that the lattice may simultaneously seize and convey fibers across the width of said filling chute for increased mixture of fibers from said bales arranged in said row.

11. The method of claim 10 including conveying said fibers in said filling chamber in a direction inclined to said feed lattice by means of an inclined filling chute which is inclined to a lower portion of said spiked feed lattice.

12. The method of claim 11 including providing an outlet chute defined in part by said spiked feed lattice arranged in a fiber advance direction of said spiked feed lattice for conveying said fiber to an outlet for further delivery to said associated processing machine.

13. The method of claim 12 including providing a variable wall in said outlet chute to vary the width of said outlet chute between said spiked feed lattice and said adjustable wall.

14. A process for producing a mixture of fiber material, such as cotton and the like fed to a hopper feeder from a device for opening pressed bales of fiber materials set up in series in which the opened fiber material is removed layerwise successively from the bales and fed pneumatically into a filling chamber of the hopper feeder to form a fiber material bed and from there to a processing machine, wherein the improvement comprises supplying the fiber material continously removed from the row of bales to the filling chamber of the hopper feeder lengthwise of the fiber bed under formation and removing the fiber bed in a height direction at one longitudinal side of said fiber bed.

15. Process according to claim 14 wherein feeding of the fiber material to the filling chamber is performed by a reciprocating movement of a feeding means at adjustable different speeds and controlling the speed of the feeding means in dependance on the speed of a removing device of the bale opener.

16. Apparatus for mixing fiber material, such as cotton and the like, in a hopper feeder fed by a device for opening pressed bales of fiber material set up in a row, in which the hopper feeder includes a filling chamber and a reciprocating feeding means for feeding the fiber material supplied by a bale opener having a removing device which opens and removes layerwise the fiber material from the bales set up in rows, wherein the improvement comprises the feeding means being mounted on the hopper feeder in a manner that the feeding means reciprocates lengthwise of a fiber material bed being formed in the filling chamber and a removing means disposed at one longitudinal side of the fiber material bed for removing fiber from said fiber bed in a manner that that fiber is removed by said fiber removing means in a direction of the height of said fiber bed simultaneously along generally the entire longitudinal side of said bed.

17. Apparatus according to claim 16 including a variable speed driving means for driving the feeding means of the hopper feeder, and said driving means for the feeding means of the hopper feeder and a second driving means for the reciprocating frame of the bale opener are controllable interdependently related to each other.

18. Apparatus according to claim 16 wherein the feeding means is a pneumatically operating condenser which is connected to the removing device of the bale opener for the fiber bale row.

19. Apparatus according to claim 16 wherein the filling chamber of the hopper feeder includes a bottom conveyor belt movable transversely to the longitudinal side of the fiber material bed.

20. Apparatus according to claim 16 wherein said fiber removing means includes a spiked feed lattice and the hopper feeder includes said filling chamber which is defined by oblique walls inclined to a lower part of the spiked feed lattice, and a filling aperture included in the filling chamber which extends in direction of the chute width which is fed by said feeding means.

21. Apparatus according to claim 20 including a chute chamber ahead of the spiked feed lattice extending at an inclined angle to the filling chamber.

22. Apparatus according to claim 21 wherein the chute chamber is adjustable in width by an adjustable wall.

23. Apparatus according to claim 16 wherein the filling chamber includes vertically extending boundary walls.

24. Apparatus according to claim 16 characterized in that the filling chamber is subdivided into sections by transverse walls and the subdivided filling chamber sections are provided with a removable cover.

* * * * *